US005834647A

United States Patent [19]

Gaudriot et al.

[11] Patent Number: 5,834,647

[45] Date of Patent: Nov. 10, 1998

[54] ACTIVE DEVICE FOR ATTENUATING THE SOUND INTENSITY

[75] Inventors: Lionel Gaudriot, Dommartin; Jacques Martinat, Caluire, both of France

[73] Assignee: Comptoir De La Technologie, France

[21] Appl. No.: 817,789

[22] PCT Filed: Oct. 10, 1995

[86] PCT No.: PCT/FR95/01318

§ 371 Date: Apr. 18, 1997

§ 102(e) Date: Apr. 18, 1997

[87] PCT Pub. No.: WO96/13029

PCT Pub. Date: May 2, 1996

[30] Foreign Application Priority Data

Oct. 20, 1994 [FR] France ..... 94 12761

[51] Int. Cl.[6] ..... G10K 11/16

[52] U.S. Cl. ..... 73/570; 381/71.8; 381/71.12; 381/73.1

[58] Field of Search ..... 73/570; 381/71, 381/73.1, 94, 158, 71.7, 71.8, 71.9, 71.11, 71.12, 71.13, 71.14; 181/206; 367/136, 901; 364/574

[56] References Cited

U.S. PATENT DOCUMENTS

| | | | |
|---|---|---|---|
| 4,208,735 | 6/1980 | Suzuki et al. | 367/136 |
| 4,829,590 | 5/1989 | Ghose | 455/63 |
| 5,224,168 | 6/1993 | Martinez et al. | 381/71 |
| 5,363,451 | 11/1994 | Martinez et al. | 381/71 |
| 5,438,624 | 8/1995 | Lewiner et al. | 381/71 |

FOREIGN PATENT DOCUMENTS

| | | |
|---|---|---|
| 0557071 | 8/1993 | European Pat. Off. . |
| 1494967 | 9/1967 | France . |
| 91 10259.6 | 1/1992 | Germany . |
| 92/20063 | 11/1992 | WIPO . |

OTHER PUBLICATIONS

"Active Control of the Sound Radiated by a Vibrating Body Using Only a Layer of Simple Sources", The Journal of the Acoustical Society of America, (Apr. 1995) No. 4.

*Primary Examiner*—Hezron E. Williams
*Assistant Examiner*—Rose M. Miller
*Attorney, Agent, or Firm*—Wall Marjama & Bilinski

[57] ABSTRACT

A device for attenuating noises generated by moving sources includes a set of arranged electroacoustic sources which emit an opposite antinoise wave in response to an incident wave as sensed and processed. The electroacoustic sources are arranged to preferably emit a synchronous antinoise wave having a radius of curvature approximating that of the incident wave.

9 Claims, 5 Drawing Sheets

ACTIVE DEVICE FOR ATTENUATING THE SOUND INTENSITY

FIELD OF THE INVENTION

The invention relates to a stationary device for attenuating noises generated by moving sources, and more precisely transport means such as aircraft or ground transportation.

BACKGROUND OF THE INVENTION

Transport noise is the main nuisance form of pollution affecting residential areas, indoors, when the windows are open and outdoors in gardens, parks, green spaces and terraces. This nuisance is increasing inexorably over time in most urban or suburban regions because of the increase in traffic, in particular resulting from the improvement in vehicle performance, this being in spite of the constant improvement in terms of their intrinsic noise level.

In view of the physical nature of sound, that is to say a pressure wave propagated "mechanically" in air, this implies that the only way of being protected from noise is to be sheltered by a screen interposed between the noise source and the region to be protected. This screen reflects or absorbs the sound which is received.

This solution is mostly used, either with walls of property or with "antinoise" walls, along traffic lanes. When it is economically and aesthetically acceptable, this solution is satisfactory. Unfortunately, its performance is limited by the effect of diffraction of the sound behind the screen, the effects of which are essentially connected with the span of the screen and the distance between the noise source (or the region to be protected) and the screen, these distances being taken relative to the wavelength of the sound to be attenuated.

However, for the noise produced by aircraft on take-off, a screen which allows a high level of protection is in general not architecturally acceptable.

In all cases, the optical opacity of the screens leads to an often unacceptable loss of view and light. Finally, the reflection of the incident noise increases the sound intensity nearby and often prohibits the use of a solution of this type.

These reasons create a need for acoustic screens which are more lightweight, open and transparent, and are designed with a view to being installed in an architectural assembly or an industrial plant.

With this in mind, it is possible to reduce the noise emitted by sources by adding to them a device which generates an opposite sound wave which, by interfering and combining with the initial wave, reduces the overall total sound intensity. This combination is possible by virtue of the fact that the auxiliary source, slaved to the main source, generates waves which have the same origin and therefore the same geometry. This device is, in particular, applied to car exhausts. A fortiori, it makes it possible to equip fixed installations of machines which emit noise, for example industrial gas outlets or air-conditioner blowers as described in patent EP-A-0,557,071. In order to be effective, these devices need to be attached to the main noise source, which cannot be envisaged for many transport means, in particular aircraft.

Stationary devices have also been proposed which are intended to be installed in a region which it is desired to protect. For example, document FR-A-1,494,967 describes a general electroacoustic device for absorbing sound and noise, comprising a plurality of secondary sound sources, each of which consists of a microphone, directed at the sound source to be neutralized, an amplifier and a loudspeaker directed towards the region to be protected, and is intended to emit a sound signal, with the same amplitude but opposite sign, in the direction of the said region.

However, this device presupposes that the secondary sources are distributed over a closed surface which covers all of the volume to be protected, which is not the case for a screen, the edge effects of which are a significant factor.

Furthermore, it presupposes that the acoustic centre of the microphones coincides with that of the associated loudspeakers, which is practically unachieveable for the following two reasons:

- the microphone system must discriminate sufficiently between the pressure of the incident noise wave and the pressure of the antinoise wave generated by the associated loudspeaker, which requires a prohibitive number of microphones;
- if the acoustic centres coincide, there is no time for the acquired signal to be applied to the loudspeaker, and so the group propagation time of the waves in the vibrating structures of the loudspeaker cannot be compensated, and the signal cannot be preprocessed.

SUMMARY OF THE INVENTION

The invention overcomes all these drawbacks.

The problem which the invention therefore proposes to solve is that of compensating, in a determined region, for the noise waves emitted by far-field sources, these waves being substantially plane in the region to be protected.

In other words, the problem which it addresses is to generate waves with a very large radius of curvature, using electroacoustic sources which are located relatively close to the region to be protected and therefore inherently generate waves with a small relative radius of curvature. The object of the invention is to allow the protection of an outdoor area from the noise produced by sound sources located at distance, for example at altitude, such as, in particular, aircraft noise close to an airport runway (on take-off, landing or when flying over).

The invention relates to an active device for attenuating the sound intensity in a determined region by emitting antinoise waves, the device comprising:

- a set of sensors which can determine the signals and the directions of incident waves emitted by the distant noise sources;
- means for processing the signals emitted by the said sensors, and for generating signals corresponding to the antinoise waves;
- a set of electroacoustic sources, connected to and capable of emitting antinoise waves in the same direction and in the same sense as the incident waves, the sensors and the electroacoustic sources being placed in such a way that the incident waves reach the sensors prior to the determined region.

This device is characterized in that the electroacoustic sources are installed in the space close to the region to be protected and, in that the antinoise waves emitted by the set of electroacoustic sources combine to form the waves assuming the incident waves as envelopes.

In other words, the device is composed of a plurality of sensors and sound sources which can reproduce the characteristics of the incident wave and can emit an opposite wave. These sound sources are placed around and above the region to be protected, which they cover only partially.

The invention consists in arranging the various sources relative to one another in such a way that the combination of the waves emitted by each source takes the form of a quasi-plane wave as close as possible to the geometry of the incident wave. For this reason, with respect to the wave to be neutralized, the resultant antinoise wave is not only of equal amplitude and opposite sign, but also, and above all, it has a similar curvature. Thus, throughout the volume to be protected, the antinoise wave and the incident wave compensate each other geometrically and in amplitude, thus fulfilling the two conditions necessary for reducing the intensity of the sound field by their interference.

Advantageously, the device also comprises at least one sensor placed in the sonically irradiated region and connected to the processing means, thus allowing optimal regulation of the antinoise wave in the region to be treated, by controlling a feedback loop allowing the gains and delays of the antinoise signal to be adapted continuously.

In one practical embodiment, the acoustic sources are grouped in subsets and aligned with a common axis. This axis may be rigid, for example a mast, or alternatively a stretched cable. Satisfactory results are obtained with a number of 4 to 10 loudspeakers per subset, and preferably close to 8.

In practice, each source subset is placed at a vertical or transverse distance from the region to be protected of between 3 and 20 meters, preferably between 3 and 12 meters, and the unitary surface protected by a subset is between 10 and 30 $m^2$.

In fact, under these conditions, the wave resulting from the interferences between the various sound sources has a quasi-plane leading front with sufficient coverage with respect to the underlying volume.

Between 5 and 12 m, a good compromise is reached between the number of sources necessary, the planarity of the resultant wave, the fixation possibilities and the covering surface.

The sensors are placed sufficiently far upstream of the acoustic emitter for the propagation time of the instant wave between the sensor and the loudspeaker closest to the emitter to be greater than the time for constructing the antinoise wave.

The microphones used advantageously have a directionality diagram with a sensitivity minimum in the half-space directed towards the emitter, so as to be protected against waves reflected by the ground and the obstacles nearby, and also from the back radiation of the antinoise sources.

In other words, the invention consists in arranging, above the protected region, a set of electroacoustic sources which each emit an antinoise wave, the various emitted antinoise waves combining to form a resultant antinoise wave whose radius of curvature approximates that of the incident wave, so that this wave envelopes its combined leading front.

It is easy to see that the antinoise wave emitted by each set of sources thus remains tangent to the incident wave in a direction normal to the propagation direction of this wave, but over a limited area of this wave, corresponding somewhat to the "shadow cast" by the source set on this wave. Actually inside this surface, there is a problem due to the lateral contribution, that is to say in directions which are oblique with respect to the propagation direction of the incident wave, from the adjacent source sets, the radiation of which somewhat overlaps the useful antinoise signal. In order to solve this problem, it is necessary to provide electroacoustic sources which have increased directionality, which is obtained in that each acoustic subset includes at least four sources arranged vertically on each mast and controlled by time-shifted signals. In this way, the directionality is oriented preferentially in the alignment direction of the acoustic sources. Control over the mutual lateral influences of the adjacent sources is thus achieved.

Of course, the invention is not simply limited to attenuating incident sound waves which propagate vertically, or more generally parallel to the axes of the masts. Thus, in order to adapt the direction of the antinoise wave consisting of the sum of the waves emitted by each source of each subset, the time shifts between the actuation of each of these sources are a function of the angle of incidence of the incident wave.

As is known, the pressure field radiated by a vibrating diaphragm is an inverse function of the distance from the point in question to the diaphragm. More precisely, the radiation mechanism corresponds to an integral effect over the geometric domain of the elementary sources.

More generally, if the set of diaphragms constituting a subset of sources is considered, followed by all the subsets of sources, the total radiation mechanism corresponds to an integral effect over the geometric domain of all the diaphragms. Since the antinoise signals delivered by these diaphragms are suitably time-shifted to make the overall antinoise wave coincide with the incident noise wave, the spatial integral effect over all the diaphragms results in a time-integral effect of the overall antinoise signal supplied.

Thus, according to another important characteristic of the invention, each electroacoustic source is controlled in such a way that the acceleration of the diaphragm of the electroacoustic source is proportional to the derivative of the antinoise pressure signal. Thus, by virtue of the overall radiation mechanism, the desired antinoise signal is indeed obtained.

As mentioned above, the antinoise wave resulting from the combination of the various elementary antinoise waves is supposed to take the incident noise wave as its envelope. It is easy to see that the invention should solve a problem of making the wave portions located between the contact regions coincide. In fact, since the radiated elementary waves are quasi-spherical, a problem arises of time-shifting in these regions between the points of the incident wave front and those of the antinoise waves.

Thus, the antinoise signal emitted is the linear filtrate of the signal of the incident wave, filtered by a filter matched permanently to this signal, the said filter being intended to temporarily broaden the cross-correlation function between the noise signal and the antinoise signal.

In other words, according to this other characteristic of the invention, the antinoise signal emitted is not strictly equal to the opposite of the noise signal to be counteracted. In fact, as an approximation, forming an antinoise signal which includes a fraction corresponding to the opposite of the noise signal and a complementary fraction corresponding to the opposite of the noise signal with a slight time lead, ensures, according to an energy criterion, that the various antinoise waves emitted coincide temporally, this being within a determined frequency range.

The invention which is described corresponds to a single noise source, such as an aircraft on take-off, whose pressure wave is detected and the incidence is measured simultaneously, for example, by cross-correlation of the signals on a horizontal base with two microphones.

When the invention is applied to multiple sources, for example a stretch of a road traffic artery, it is necessary to separate the characteristics of each source—pressure signal and angle of incidence—in order to apply them simultaneously, but separately, to the antinoise system described. In order to detect these signals, it is necessary to apply a spatio-temporal filtering of the signals, by increasing the number of microphones in the base, in order to extract therefrom the information needed to drive the system.

BRIEF DESCRIPTION OF THE DRAWINGS

The way in which the invention may be embodied, and the advantages which result therefrom, will emerge more clearly from the following illustrative embodiment, supported by the appended figures.

EMBODIMENT OF THE INVENTION

The object of the device according to the invention is to form an active screen against various sources of noise, in particular the noise generated by transport means, for example an aircraft on take-off. It is more particularly intended to protect open spaces such as terraces, house fronts, gardens, parks or recreational spaces.

Figure 1:
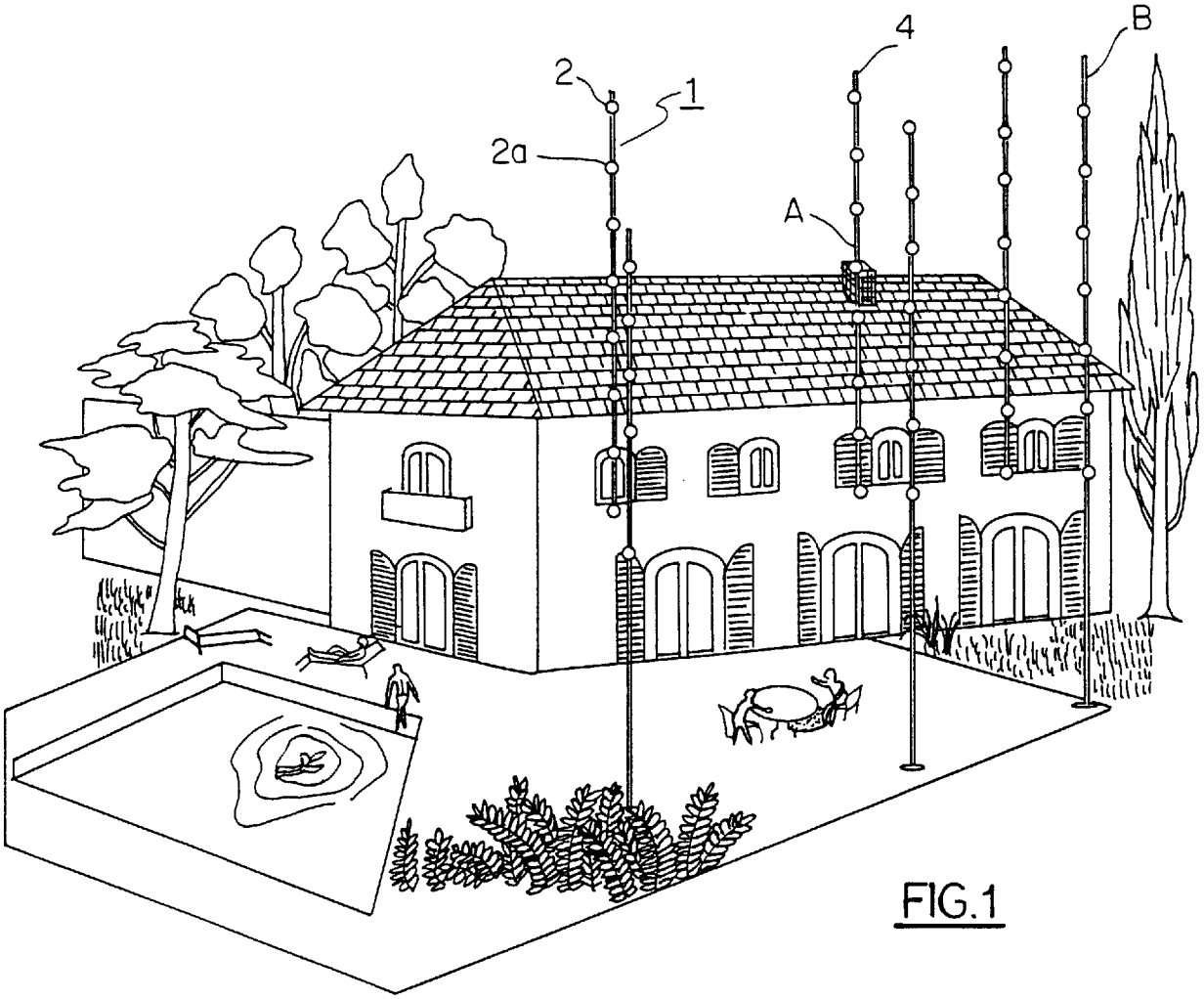
FIG. 1 is an overall view of a dwelling equipped with various devices according to the invention.

As represented in FIG. 1, the device (1) according to the invention includes a plurality of subsets of sound sources installed at various locations, namely:

- on a wall, in the manner of a lamp or a projector or a fitment (A);
- fixed to the top of a mast, in the manner of a street lamp (B);
- or in variants which are not illustrated, fixed to the branches of a tree, like a projector.

Figure 2:
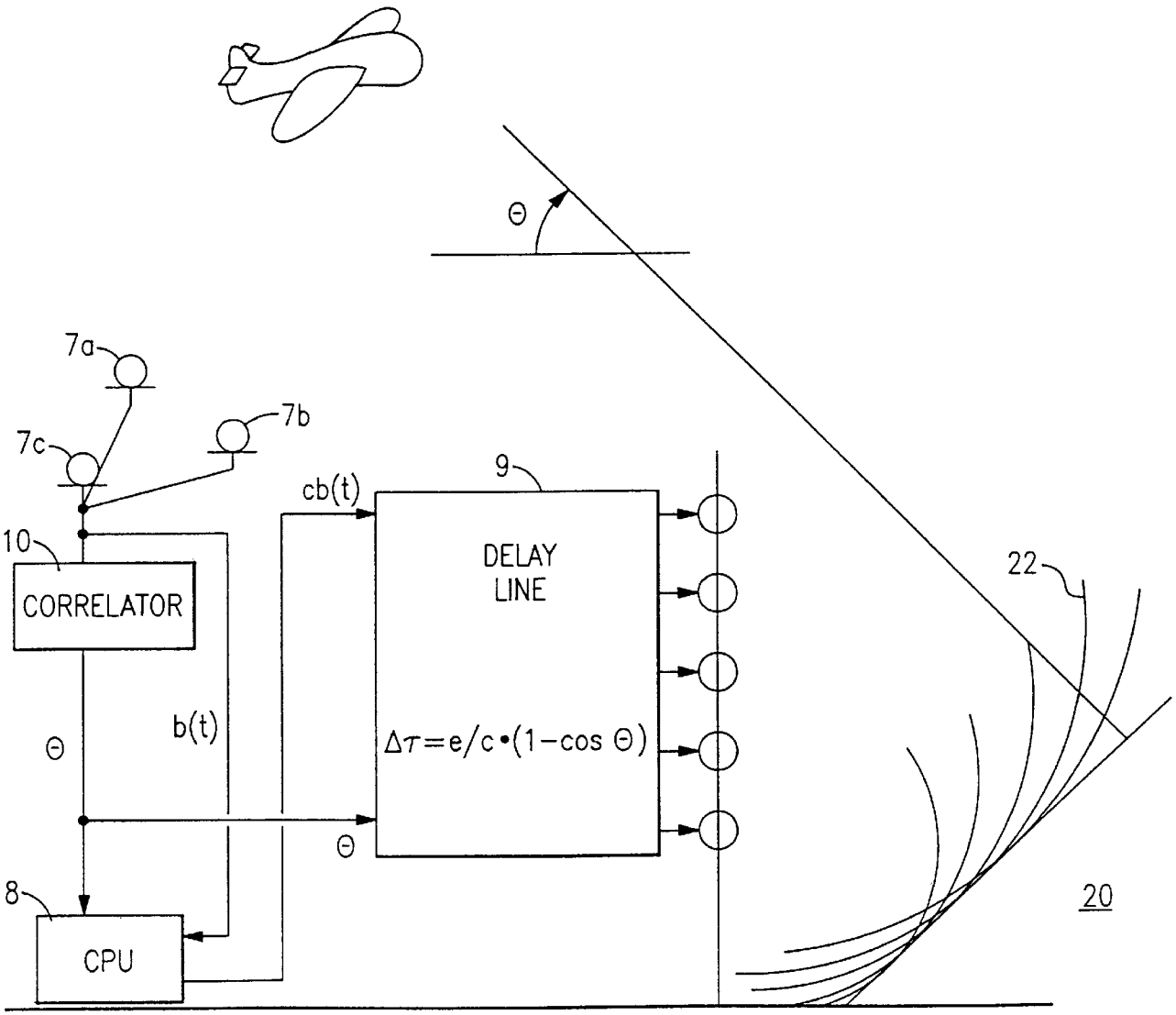
FIG. 2 is a schematic diagram illustrating the different phases in the processing according to the invention.

The device (1) according to the invention is intended to counteract sound pollution generated by aircraft noise (see FIG. 2). The waves (20) emitted by aircraft have the main characteristic that they are quasi-plane and coherent in a region of limited area, that is to say an area whose dimensions are a few tens of meters. The device therefore operates by generating a wave which is as plane as possible and is the opposite of the incident wave (20). Since it is impossible to obtain a quasi-plane wave with a point source at finite distance, the invention combines the use of a plurality of sound sources (2) to obtain a wave which is close enough to obtain the desired concentration effect at any point in the protected region.

The sources, that is to say the groups of loudspeakers, as described, have their centres of gravity distributed over a fictitious surface covering the region to be protected, according to the shape of this region and the directions of the incident waves. Their number is fixed by the minimum distance to be kept between each of them in order to produce the requisite planarity of the antinoise wave.

From the point of view of equipment, the sources are grouped in subsets carried by masts (4), so as to form the analogy of a street lamp with a height of 10 to 8 meters in the case of a square grid with a side length of 4 to 5 meters. It has been observed that very good results were obtained by using a number of loudspeakers (2) per mast of close to 10, each of the loudspeakers being separated from its neighbour **(2*a*)** by about 70 cm, this spacing being equivalent to an interval of 2 milliseconds in the control shift between successive loudspeakers.

In another practical embodiment (not illustrated), the subsets are mounted on masts suspended from a structure which has only a few bearing points on the ground. Typically, these masts only have a useful length of close to 7 meters and the bottom end of each mast ends at about 3 meters above the ground. This embodiment leaves space free for people to walk and seems preferable for large areas which are to be protected.

OPERATING PRINCIPLES OF THE INVENTION

The subsets described above operate in a direct mode, insofar as they generate acoustic waves which are the direct opposites of the aircraft noise waves. In response to an incident overpressure, they react with an underpressure of equal amplitude. They detect the incident waves upstream of the system of loudspeakers, into which suitable signals are injected which can create the desired opposite effect, at any point in the protected region and synchronously with the incident wave.

In order for such subassemblies to operate properly, measured by the noise attenuation performance obtained (of the order of 10 to 20 dB, i.e. 1/10 to 1/100 in acoustic power), their embodiment must meet the following essential physical requirements.

1) The antinoise signal must be particularly faithful as regards the noise signal to be attenuated. This places very stringent requirements on the performance of the acoustic reproduction system. It is typically deemed necessary to have a correlation coefficient of more than 0.995 between the antinoise signal and the noise in order to achieve an attenuation performance of 20 dB, which demands system distortions of at most a few thousandths (linear and non-linear distortions).

Figure 3:
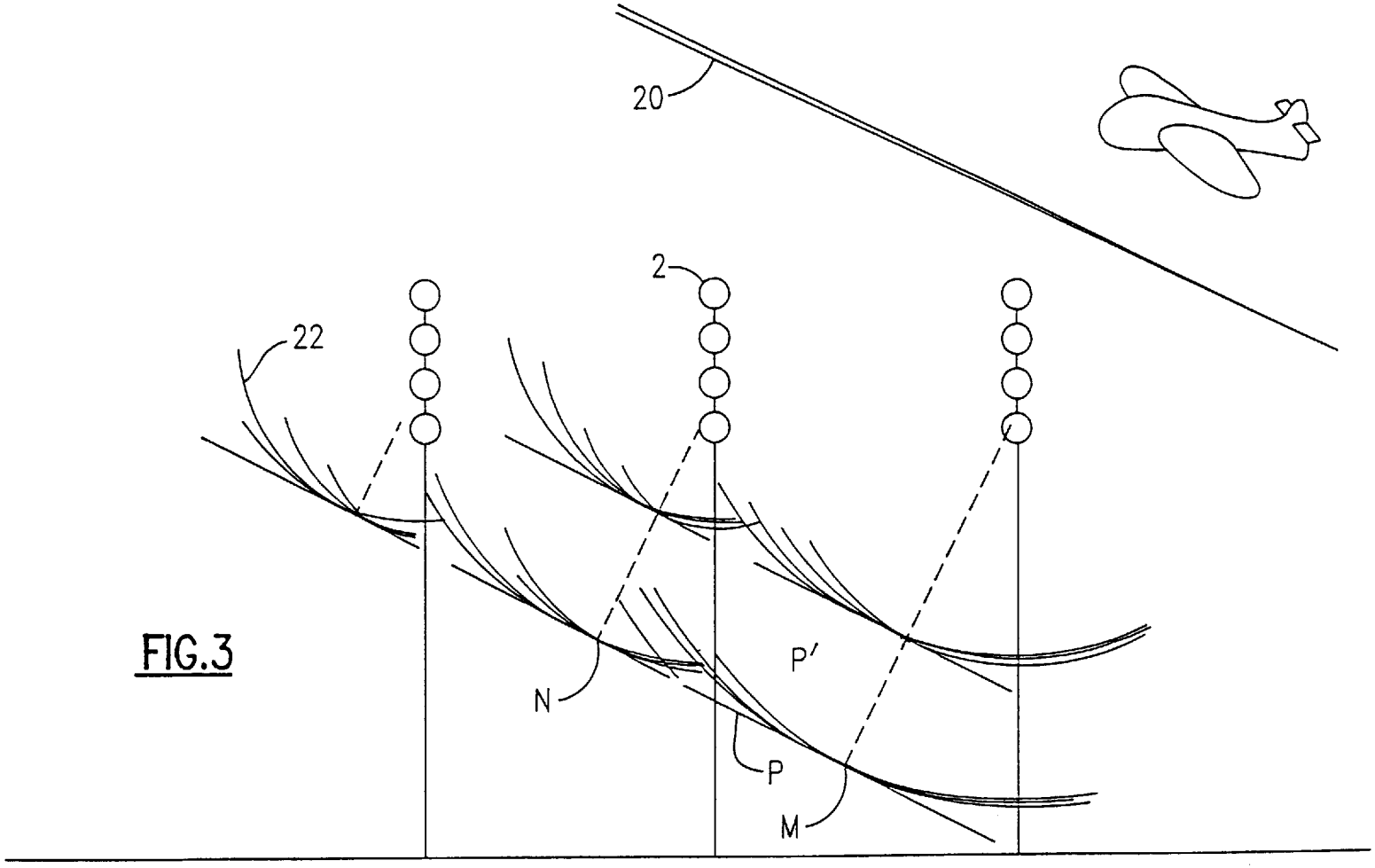
FIG. 3 is a schematic diagram making it possible to visualize the response of a subset of sources arranged and controlled according to the invention.

2) A requirement of spatial coherence of the antinoise wave system (22) generated by the subsets with respect to the noise waves originating from the aircraft. The incident wave has a large radius of curvature, typically several hundreds of meters. The waves generated by the subsets have much smaller radii, typically 3 to 10 meters, which corresponds to the height at which these subsets are placed. These antinoise waves therefore need to be combined in order to "geometrically envelope" the noise waves. This spatial coherence requires that the following two problems be solved:

a) A problem of homogeneity: the amplitude at the point P (cf. FIG. 3) where the two antinoise waves are superposed must be equal to the amplitude at the tangency points M and N, typically to 10% in order to obtain a minimum attenuation of 20 dB.

b) A problem of concomitance: the antinoise wave created at P has a lag relative to the noise made at P', and is therefore not strictly its opposite. It is typically required for a correlation loss to be less than $5.10^{-3}$ in order to obtain attenuation of 20 dB.

While the temporal coherence requirement raises a problem of acoustic technology, and more particularly loudspeaker design and correction, the spatial coherence requirement corresponds to an acoustic signal-processing problem.

As regards the problem of spatial coherence of the antinoise wave system with the noise waves, one of the essential characteristics of the invention is to distribute and associate loudspeakers provided with their own directionality in order to construct a desired combined directionality.

In fact, if the wave fronts created by each loudspeaker are overall spherical at the distance of interest, the nature of the acoustic field behind these fronts, which conditions their directionality, in particular, can be altered according to the actual geometry of these loudspeakers, and the inert surfaces which envelope them. The way of addressing these phenomena which seems most enlightening is to consider the impulse response of these loudspeakers, and of their combination. This impulse response is a causal function which makes it possible, by convolution with the antinoise signal, to obtain the real acoustic response of the system intended to be used against the aircraft wave proper, in the audible region.

As regards the modelling of the antinoise sources, they are likened, to first approximation, to sources with normal acoustic output variation, the pressure field of which is given by the law:

$$p \cong 1/r \cdot \rho \cdot \gamma(t-r/c)$$

where "r" represents the distance from the point in question to the source, "ρ" represents the density of air, "γ" represents the acceleration of the source and "c" represents the speed of sound.

There are, of course, equivalences between the various pressure laws corresponding to the different types of elementary acoustic sources, these correspondences being well known to the person skilled in the art.

As regards determining the impulse response of a set of loudspeakers, this will be based on the principle of the conservation of the mechanical momentum imparted by the diaphragm isotropically to the ambient air.

It appears that the radiation mechanism which corresponds to an integral effect over the geometric domain of the elementary sources is actually manifested by an integral effect, or a time quadrature effect, of the pressure signal detected with respect to the source output variation signal. Thus, according to an important characteristic of the invention, in order to obtain a given antinoise pressure signal, the acceleration of the diaphragm of the loudspeakers is controlled by the signal which is the derivative of the signal which it is desired to obtain. More precisely, and schematically, it could ideally be desired for the antinoise sources to give impulse responses of the type $P\theta(t) \cdot e^{-t/T}$, at a point, where $P\theta(t)$ is the carry signal of duration θ and amplitude 1/θ. Convoluted with the acceleration signal γ(t) of the sources, this pressure response gives:

$$\gamma(t)^{*}P\theta(t) \cong \Gamma(\tau) - e^{-\theta/t} \cdot \Gamma(\tau-\theta)$$

It will be noted that the convolution is strictly equivalent in the spectral domain to a low-pass filtering which leads to the first formula $\omega_o = 1/T$ which gives the bottom cut-off frequency of the system.

The intended result, that is to say a radiated pressure which is close to the primitive therefore requires θ/T>3 in practice.

The value of θ is fixed by the geometry of the street-lamp system, typically $\theta - L_{max}/c$, $L_{max}$ representing the maximum horizontal distance between loudspeakers. Combining the above equations leads to $\omega_o > 3c/Lmax$, which clearly shows that the bottom cut-off frequency of the antinoise system is in inverse ratio to its span.

For the same reasoning, it is therefore necessary that, at the current point in the space to be protected, the union of the impulse responses of the various loudspeakers whose antinoise waves reach the current point approximate the desired impulse response or base of the type: $P\theta(t)e^{-t/T}$.

It is essential, in particular, for the union of these responses to coincide at any point with the leading front and to have the same energy amplitude everywhere. Schematically, the system should be designed in terms of arrangement and directional character such that the impulse responses link together at any point according to a rapidly decreasing law which is as close as possible to an exponential $e^{-t/T}$.

The consequence of this is that the street lamps must be designed to be highly directional.

The furthest contributions of the leading front of the overall impulse response, corresponding to incidences close to the horizontal, should thus be attenuated according to a law which, if not exponential, at least varies sufficiently quickly as the inverse of the propagation time to the current listening point.

Furthermore, depending on the layout of the street lamps, a plurality of them contribute together to the impulse response at the current point (typically, the four closest subsets in a square grid). This increases the need to concentrate the vertical directionality of the subsets. In order to solve this crucial problem, according to one characteristic of the invention, the loudspeakers are arranged in subsets which are aligned, in particular on a mast.

Figure 4:
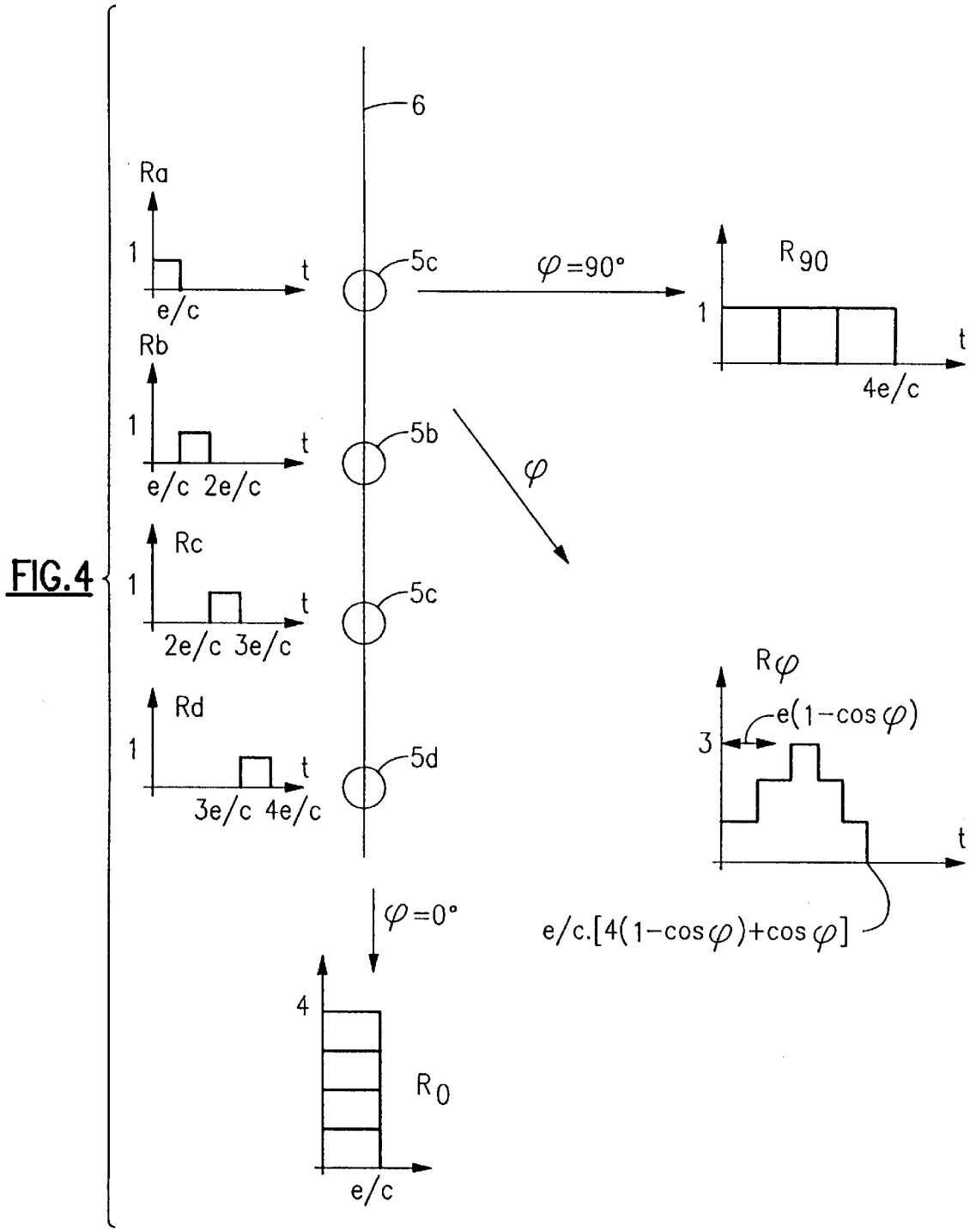
FIG. 4 is a schematic diagram showing the generation of antinoise waves by a set of masts equipped with sources according to the invention.

Schematically, if these sources are distributed on a mast, while separating them by a distance e, and by exciting them progressively with a unitary time lag e/c on the signal, the axisymmetric angular diagram in FIG. 4 is obtained, which illustrates the individual and overall impulse responses. Schematically, it is observed that the various impulse responses combine in a way which differs according to the azimuth ϕ observed.

The four sources (5*a*, 5*b*, 5*c*, 5*d*) are controlled with a time shift equal to the time which the wave takes to cover the distance between loudspeakers, the four impulse responses (Ra, Rb, Rc, Rd) adding to form an impulse-type response R0 which is four times greater. Conversely, for an azimuth equal to 90°, the four impulse responses follow each other in time and link together to form a response R90 of variable amplitude but of quadruple duration. In between, for an azimuth of between 0 and 90°, the impulse responses combine so as to give a wave Rϕ which has an amplitude of between 1 and 4 and has a duration which is a function of ϕ and is between e/c and 4e/c.

A common aspect of these impulse responses is that they have a constant area because of the conservation of momentum law mentioned above.

It can thus be seen that the directionality of a composite acoustic source of this type is much more highly centred on the alignment axis (6) of the loudspeakers.

Of course, appropriate adjustment of the time shift between the actuation of the various sources constituting a subset allows advantageous orientation of the directionality maximum as a function of the angle of incidence of the wave emitted by the aircraft.

Of course, in view of the distance to the various street lamps in a horizontal plane, the various loudspeakers forming a subset should be positioned at suitable heights. Thus, it is considered that the satisfactory result is obtained by using masts on which the highest loudspeaker is located at about a height equal to twice the average distance separating two adjacent masts. Furthermore, the lowest loudspeaker on the mast should be placed at a height substantially equal to half this inter-mast distance, but substantially without descending below one and a half times the height of a man.

TREATMENT OF THE CONCOMITANCE PROBLEM

As a preliminary, the spectral nature of the noise which the invention is intended to counteract should be pointed out. The incident noise has two main features:

- it consists of a mixture of determined periodic components due to the interaction between flow and parts which rotate but which are nevertheless noisy, as well as random components due to the turbulence phenomena in the combustion chamber and, above all, to the jet. The determined components are predominant in the noise pollution effect;
- the incident noise varies during flyover because of the directionality of the sources, the Doppler effect and possible randomness in propagation due to atmospheric turbulence.

The noise waves perceived on the ground during the flight phases in question nevertheless remain coherent laterally over several tens of wave lengths, that is to say over the span of the regions to be protected.

Figure 5:
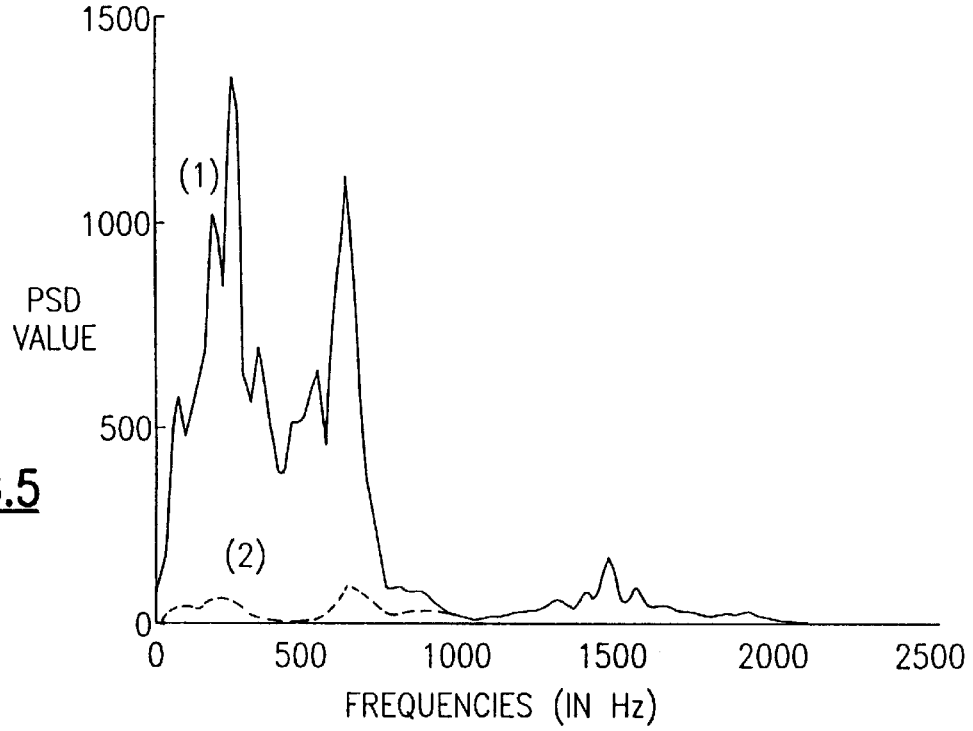
FIG. 5 is a comparative graph representing the spectral noise densities, respectively of an aircraft measured during the take-off phase, and the resultant signal when the antinoise wave is added.

FIG. 5 presents, in solid line, a typical appearance of the spectral power density of the incident noise, averaged over about 500 milliseconds. It shows the magnitude of the noisy lines as well as that of the average part of the spectrum, lying between 200 and 800 Hz. Also shown is the weighted relative part of the top part lying between 1 kHz and 2 kHz, which is more difficult to counteract.

Statistical calculations make it possible to determine the values of the correlation coefficient between the incident noise signal which has been received and the antinoise signal to be emitted. This calculation demonstrates that, in order for the antinoise to achieve a theoretical noise attenuation performance of 20 dB, it is necessary to ensure a normalized cross-correlation of the antinoise signal with the noise signal to within $5.10^{-3}$ over the lag interval $[0, T_{max}]$ with the power levels equal to within a tenth.

The result of this, in the typical case of using street lamps with a height of 10 meters separated by 5 meters each, is that the value of Tmax is substantially equal to one millisecond. However, this corresponds substantially to the first value at which the noise auto-correlation function becomes zero. It can therefore be seen that it is necessary for the system to minimize this lag effect if it is desired to achieve the intended performance. It should be noted that, in some examples, the interference created by the antinoise signal with the noise signal may become constructive and generate an increase in the sound volume, which is obviously unacceptable.

According to an important characteristic of the invention, and in contrast to a drawback of having to construct the antinoise signal cb(t) as the strict opposite of the noise signal b(t), this antinoise signal is in fact a function F(b(t)) which is to fulfil the required properties of correlation between the noise and antinoise signals. In other words, it is desired to give the antinoise a shape which "flattens" or at least limits the variations in the normalized cross-correlation of the noise and the antinoise.

Theoretically, this effect could be obtained by taking the following as antinoise signal (cb):

$$cb(t)=F(b(t))=b(t)*\eta(t)$$

Schematically, $\eta(t)-\alpha\cdot\delta(t)+\beta\cdot\delta(t-t_o)+\gamma\cdot\delta(t+t_o)$ where $\delta$ represents a Dirac function.

A smoothed result is obtained by using a function $\eta(t)$ which corresponds to a causal function which has bounded support, is symmetrical and has the ideal impulse structure described above.

The result obtained is illustrated in FIG. 5, which shows the spectral density of the signal resulting from the addition of the noise and the delayed antinoise, shown in dashes, which should be compared with the spectral density of the noise shown in a solid line, by using a function $\eta(t)$ based on a Dirac function. It can be seen that this technique makes it possible to compensate for the lag effect.

Figure 6:
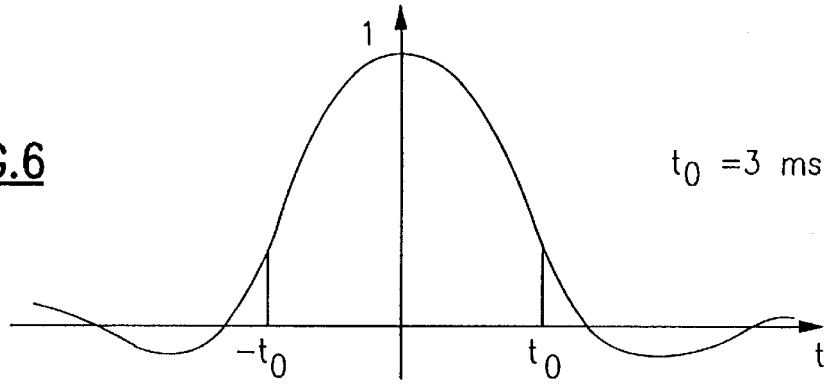
FIG. 6 is a graph representing the autocorrelation function of this type of noise in a symmetric interval of amplitude ±3 milliseconds.
Figure 7:
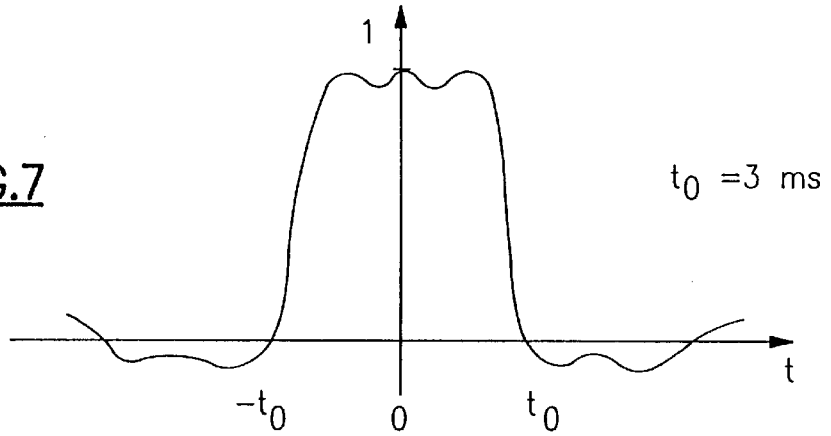
FIG. 7 is a graph showing the autocorrelation function of the antinoise signal obtained after applying the function according to the invention, on the same time-scale.

Comparing FIGS. 6 and 7 shows that applying the function to the noise signal in order to obtain the antinoise signal broadens the correlation function (FIG. 7) in comparison with the raw autocorrelation function (FIG. 6).

THE DETECTION SYSTEM

The incident wave is detected (see FIG. 2) by a set of three microphones (7*a,* 7*b,* 7*c*) constituting a double listening base and make it possible to detect the bearing angle as well as the azimuthal angle of the propagation direction of the incident wave. It can be seen that better precision is obtained when the three microphones (7*a,* 7*b,* 7*c*) are arranged in a horizontal plane, forming a right angle whose bisector plane is parallel to the plane of the most frequent flight path of the aircraft.

As regards the microphones to be used, in order to avoid feedback effects which can lead to instabilities by picking up waves reflected from the ground, it is preferable to chose microphones having an ideally hemispherical directionality diagram oriented upwards.

THE SIGNAL PROCESSING MEANS

Since the nature of the noises emitted is inherently variable and partly random, the processing assembly includes appropriate standard calculation means for performing optimal adaptive filtering, that is to say filtering which changes as a function of the variable and random characteristics of the incident noise and, more particularly, its orientation. These processing means use principles which are known in the field of statistical signal procesing, so that it need not be developed in further detail.

Nevertheless, as seen from FIG. 2 it may be pointed out that the assembly of the device according to the invention includes a listening microphone base consisting of three microphones (7*a,* 7*b,* 7*c*). These microphones are connected to a central processing unit (8) based on a signal processing architecture intended to construct the antinoise signal cb(t) on the basis of the characteristic function of the invention. This antinoise signal cb(t) is injected into a delay line (9) whose delay lag is adjusted by the value of the bearing angle $\theta$ determined by the correlator (10) receiving the signals b(t) output by the microphones.

POSSIBILITIES OF INDUSTRIAL APPLICATION

The device, as described above with reference to its application against aircraft noise, can easily be used to limit the inherent nuisance caused by other transport means, for example trains or roadways.

It can be seen from the above description that the device according to the invention presents an advantageous solution to the problems of noise, in particular of aircraft. Indeed, for a determined region, corresponding to a garden or a terrace, for example, it constitutes a discrete and optically transparent sound screen. Furthermore, it does not displace the pollution to the surroundings.

We claim:

1. An active device for attenuating the sound intensity in a determined region by emitting antinoise waves, said device comprising:

a set of sensors capable of determining the signals and directions of incident waves emitted by distant noise sources;

means for processing the noise signals b(t) from the incident waves as determined by said sensors, and for generating signals cb(t) corresponding to antinoise waves;

said generating means including a set of electroacoustic sources connected to said signal processing means, said sources being capable of emitting antinoise waves in the same direction and in the same sense as the incident waves, the set of sensors being placed such that the incident waves reach the set of sensors prior to the determined region, wherein the electroacoustic sources are installed in a location proximate to the determined region and, the antinoise waves emitted by the electroacoustic sources combine to form resultant antinoise waves having a radius of curvature approximating that of said incident waves and in which each electroacoustic source is controlled such that the acceleration of a contained diaphragm of the electroacoustic source is proportional to the derivative of the antinoise signal cb(t).

2. The device according to claim 1, including at least one sensor placed in the sonically irradiated region and connected to said signal processing means, thus allowing optimal regulation of the antinoise wave in the determined region.

3. The device according to claim 1, wherein the set of electroacoustic sources are grouped in subsets and aligned with a common axis.

4. The device according to claim 2, wherein the set of electroacoustic sources are placed at a height in the range of between approximately three and twenty meters, and a unitary surface protected by a subset of electroacoustic sources is between approximately ten and thirty square meters.

5. The device according to claim 3, wherein each subset of electroacoustic sources includes at least four sources arranged vertically on at least one mast, and controlled by time shifting the emitted signals.

6. The device according to claim 5, wherein the time shifts are a function of the angle of incidence of the incident wave.

7. The device according to claim 1, wherein the antinoise signal cb(t) emitted is the linear filtrate of the noise signal b(t) of the incident wave, as filtered by a filter matched permanently to this signal, said filter being intended to temporarily broaden the cross-correlation function between the noise signal and the antinoise signal.

8. The device according to claim 5, wherein said at least one mast includes an aiming device intended to continuously orient said at least one mast in the direction of the incident wave to be neutralized.

9. The device according to claim 2, wherein the set of electroacoustic sources are placed at a height in the range of between approximately three and twelve meters, and a unitary surface protected by a subset of electroacoustic sources is between approximately ten and thirty square meters.

* * * * *